United States Patent [19]

Smrt

[11] Patent Number: 4,946,104

[45] Date of Patent: Aug. 7, 1990

[54] SPRAYING APPARATUS WITH COUNTERWEIGHT MEMBER

[75] Inventor: Thomas J. Smrt, Cary, Ill.

[73] Assignee: Fox Valley Systems, Inc., Cary, Ill.

[21] Appl. No.: 331,265

[22] Filed: Mar. 30, 1989

[51] Int. Cl.[5] ..... B05B 1/28; B05B 9/04; E01C 23/16

[52] U.S. Cl. ..... 239/150; 239/754

[58] Field of Search ..... 239/150, 722, 754, 288–288.5, 239/578; 280/759

[56] References Cited

U.S. PATENT DOCUMENTS

| | | | |
|---|---|---|---|
| 3,614,135 | 10/1971 | Eid | 280/759 |
| 3,796,353 | 3/1974 | Smrt | 239/150 |
| 4,190,281 | 2/1980 | Chandler | 280/759 |
| 4,641,780 | 2/1987 | Smrt | 239/150 |

FOREIGN PATENT DOCUMENTS

| | | | |
|---|---|---|---|
| 2228049 | 12/1973 | Fed. Rep. of Germany | 280/759 |

*Primary Examiner*—Douglas C. Butler
*Assistant Examiner*—Karen B. Merritt
*Attorney, Agent, or Firm*—Leydig, Voit & Mayer

[57] ABSTRACT

A movable marking apparatus for marking a supporting surface includes a housing member, wheels rotatably mounted to the housing for engaging the supporting surface and rolling on it, and a handle assembly secured to a rear portion of the housing for controlling the apparatus and actuating the nozzle of a spray can. The apparatus also includes a counterweight element mounted on the front of the housing. This counterweight element prevents inadvertent lifting of the front of the apparatus and accordingly minimizes discontinuities and imperfections in the marks which the apparatus provides.

6 Claims, 1 Drawing Sheet

FIG. 3
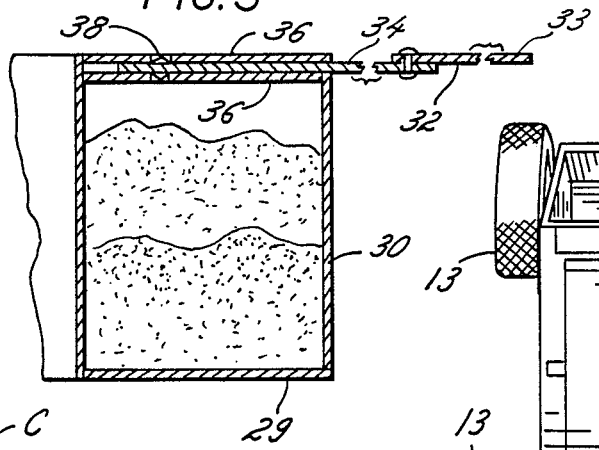
FIG. 2
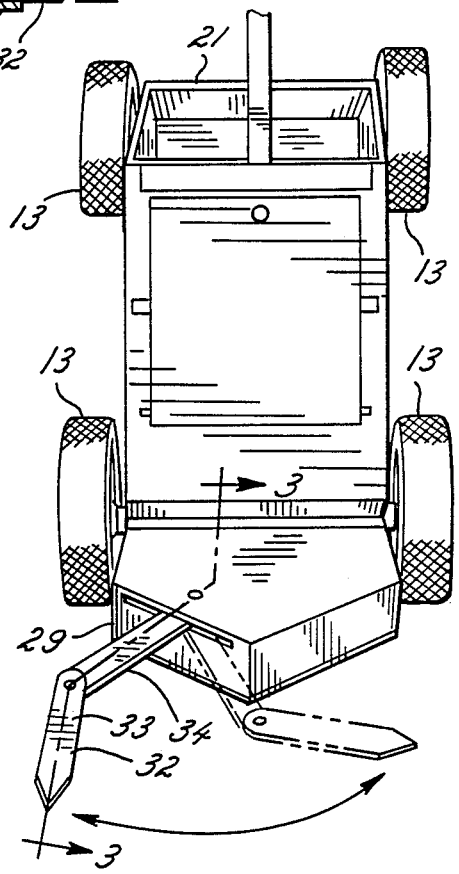
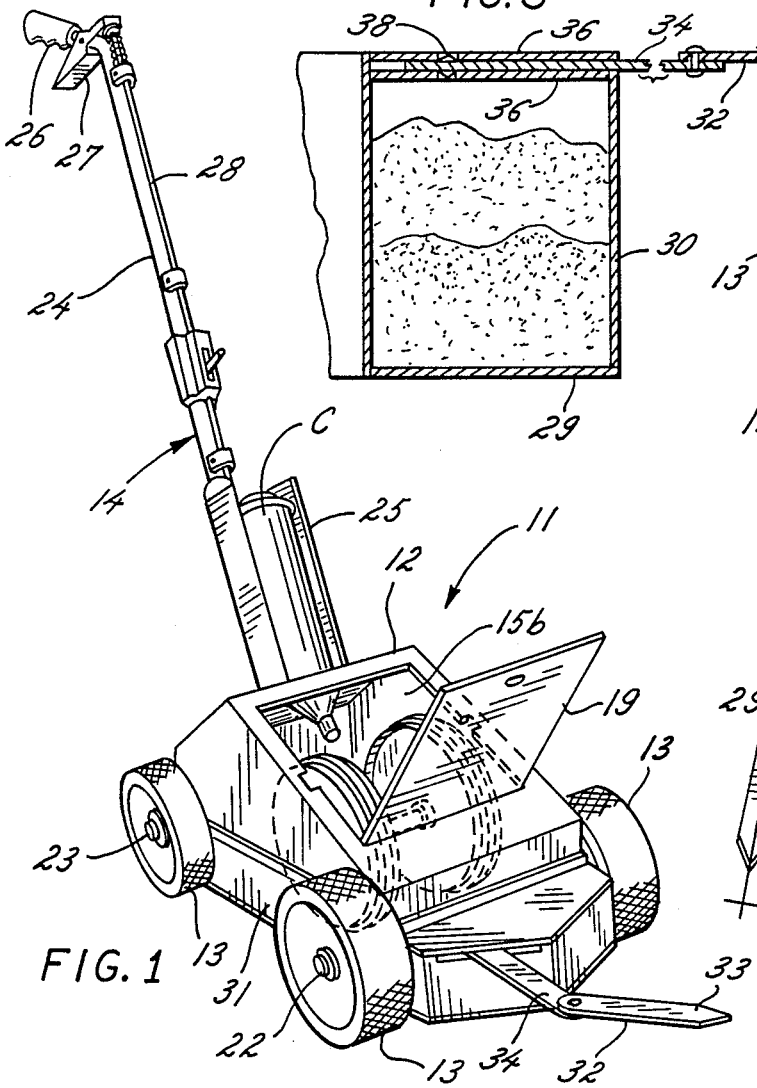
FIG. 1
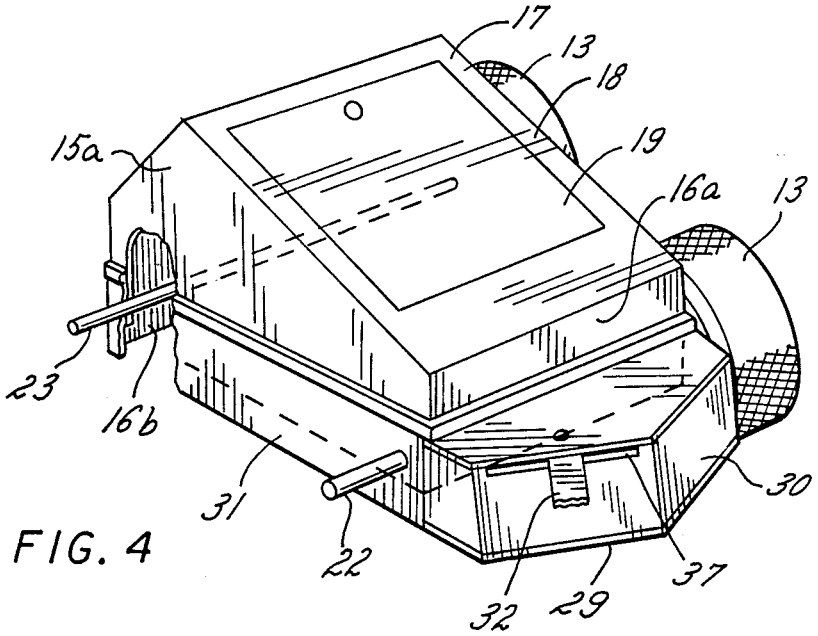
FIG. 4

SPRAYING APPARATUS WITH COUNTERWEIGHT MEMBER

BACKGROUND OF THE INVENTION

1. Field of the Invention

The present invention relates generally to a spraying apparatus with a counterweight member, and more particularly to a spraying apparatus which includes a counterweight member for preventing the front wheels of the apparatus from lifting from a supporting surface and producing unintended irregularities in the marks which the apparatus places on the supporting surface.

2. Description of the Prior Art

This invention is an improvement over the spraying apparatus described in U.S. Pat. No. 4,641,780 issued to Thomas Smrt on Feb. 10, 1987. The apparatus described in that patent includes a housing; wheels rotatably mounted to the housing for engaging a supporting surface and rolling on the supporting surface to allow easy movement of the housing; and a handle assembly secured to the housing for controlling the apparatus and activating an aerosol spray can. The housing has an open bottom; and the aerosol spray can or other container discharges its contents through the open bottom onto the subtending surface.

The handle assembly extends into the housing between the wheels of the apparatus and lies at an acute angle to the supporting surface. In addition, the material used to construct the apparatus is molded plastic or thin sheet metal. Therefore, when moving the apparatus, a user may easily and inadvertently push the handle assembly towards the surface, pivoting the apparatus on the rear wheels and lifting the front of the apparatus. This movement during operation of the apparatus results in discontinuities and imperfections in the marks provided by the apparatus.

The spraying apparatus of the present invention includes a counterbalance element which prevents the front end of the apparatus from lifting off of the surface. This element is a simple construction which minimizes the expense of manufacture and assembly and performs reliably.

SUMMARY OF THE INVENTION

In accordance with one embodiment of this invention, a spraying apparatus includes a housing which functions as a support. Wheels rotatably mounted on the housing engage a supporting surface and roll on it to allow easy movement over the surface. A handle assembly secured to the housing allows a user to control the apparatus and activate an aerosol spray can disposed on the apparatus. The aerosol spray can includes a nozzle which discharges paint onto the subtending surface.

The housing of the spraying apparatus is a box-like structure made of molded plastic or any other suitable material, e.g., sheet metal. It includes a front wall, a rear wall, and two sidewalls. A front and a rear axle extend across the housing and through suitably sized openings in the two sidewalls to rotatably mount the wheels to the housing.

The handle assembly includes a rod member secured at one end to the housing of the apparatus, proximate the rear axle of the apparatus. The opposite end of the rod member includes a handle grip and a trigger with which a user grasps the handle assembly and controls the movement of the apparatus and the discharge of marking material onto a supporting surface. The rod member lies at an acute angle to the surface.

If a user applies excessive force to the handle assembly, the assembly moves downward toward the surface, pivoting the apparatus on the rear wheels and lifting its front end. To prevent this movement, the apparatus includes a counterweight element disposed at the front end of the apparatus housing. This element includes a closed enclosure filled with sand or any other material which increases the weight of the element to a predetermined level, a level sufficient to counter the lifting force provided by the user.

The counterweight element also includes an apron which extends around the housing at the bottom of the housing. This apron includes openings which register with the openings in the sidewalls of the housing. The axles which rotatably mount the wheels to the housing extend through these openings to secure the counterweight element in place around the housing.

In addition to maintaining the front end of the apparatus on the supporting surface, the counterweight element also shields the inside of the housing from wind currents which interrupt the discharge of marking material. The element closes a substantial portion of the opening between the housing and the supporting surface, preventing wind from entering into the housing.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a perspective view of the preferred embodiment of a spraying apparatus with a counterweight element.

FIG. 2 is a front perspective view of the spraying apparatus shown in FIG. 1.

FIG. 3 is a sectional view taken along line 3—3 in FIG. 2.

FIG. 4 is a perspective view of the housing of the spraying apparatus which includes a counterweight element.

While the following text describes the invention in connection with a preferred embodiment, one should understand that the invention is not limited to this embodiment. Furthermore, one should understand that the drawings are not necessarily to scale. In certain instances, the applicant may have omitted details which are not necessary for an understanding of the present invention.

DETAILED DESCRIPTION OF THE DRAWINGS AND AN EMBODIMENT

Turning now to the drawings, FIGS. 1 and 2 shows the spraying apparatus of the present invention at 11. This apparatus generally includes a housing 12, four wheels 13 rotatably mounted on the housing 12, and a handle assembly 14. The housing 12 is a box-like structure with an open bottom through which the apparatus discharges material, e.g., paint onto a surface. It has sidewalls 15*a* and 15*b*, a front wall 16*a*, and a back wall 16*b* (See FIG. 4). It also includes an inclined top segment 17 with a front portion 18 which defines an opening and a door 19 for closing the opening and a rear portion which defines an opening 21 through which the handle assembly 14 extends into the housing.

The housing 12 is made from molded plastic or any other material of high strength and rigidity, e.g., sheet metal; and it functions as a support. (U.S. Pat. No. 4,641,780 which issued to Thomas Smrt on Feb. 10, 1987 describes the housing 12 in greater detail; and the applicant incorporates its disclosure to the present description by this reference.)

The wheels 13 lie rotatably mounted to the housing 12, two on opposite ends of a front axle 22 and two on opposite ends of a rear axle 23. Each axle, 22 and 23, extends across the housing through suitably sized openings formed in the sidewalls 15*a* and 15*b*. The wheels 13 engage a supporting surface and allow the user to push the apparatus over the surface.

The handle assembly 14 lies at an acute angle to the surface. It includes a rod member 24 releasably secured at one end to the housing 12. This rod member 24 supports a holder 25 which receives a container C, e.g., an aerosol spray can. It also supports a handle grip 26 and a trigger 27 disposed at the end opposite the one secured to the housing 12. The can holder 25 includes an opening at one end through which the nozzle of the spray can extends.

A user may actuate the nozzle using a linkage assembly 28 and the trigger 27 and apply a layer of paint or other material contained in the can to the supporting surface below the nozzle. (U.S. Pat. No. 4,262,821 which issued to Thomas Smrt on Apr. 21, 1981 describes the handle assembly 14 in greater detail; and the applicant incorporates its disclosure to the present description by this reference.)

As stated above, the handle assembly 14 lies at an acute angle to the supporting surface, connected to the housing 12 at the rear portion of the housing proximate the rear axle 23. In addition, the housing 12 is light. Consequently, the front end of the housing 12 lifts up off of the supporting surface in response to the force provided by a user in operating the apparatus. To oppose the lifting force, the apparatus includes a counterweight element 29 with an enclosure 30 and an apron 31 (See FIG. 4).

The enclosure 30 contains a material, e.g., sand, (See FIG. 3) for providing a predetermined weight to oppose the force applied by the user to the handle assembly 14. The enclosure 30 has a pentagon configuration; and it lies at the front of the apparatus 11, outward of the front wall 16*a* of the housing 12.

The apron 31 extends around the bottom of the housing 12. It is an elongate strip with one end fixedly secured to one side of the enclosure 30 and the other end fixedly secured to the opposite side of enclosure 30. The apron 31 includes openings which register with the axle openings in the sidewalls 15*a* and 15*b* of the housing 12. Thus, the axles 22 and 23 extend through these openings in the apron 31 and secure the counterweight element 29 in place around the housing 12.

The material used to construct the enclosure 30 and apron 31 is sheet metal or any other material of high strength and rigidity. This material and the manner in which the apron 31 and the axles 22 and 23 secure the counterweight element 29 and the housing 12 together allow precise control of the distance between the bottom of the element 29 and the supporting surface. One may minimize this distance, particularly at the front end of the apparatus 11, to shield the inside of the housing 12 from wind currents which interrupt the discharge of material to the subtending surface. By way of a specific example, one apparatus included an element 29 disposed 0.25 inches above a flat, supporting surface.

The counterweight element 29 further includes an indicator 32 which allows a user to follow a predetermined path defined by a chalk line or any other such marking. This indicator 32 is an articulated metal strip with one segment 33 having a pointed end and another segment 34 pivotally connected to the segment 33. One end of the segment 34 lies between two plates 35 and 36 which form the top of the enclosure 30 (See FIG. 3). These plates 35 and 36 define an opening 37 along the front of the counterweight element 29 through which the segment 34 extends. A knob 38 formed on the segment 34 extends into openings formed in the plates 35 and 36 and allows pivoting of the indicator 32.

Thus, the applicant has provided a spraying apparatus with a counterweight element which prevents inadvertent lifting of the front of the apparatus and the formation of discontinuities and imperfections in the marks which the apparatus provides. While the applicant has shown only one embodiment of the invention, one will understand, of course, that the invention is not limited to this embodiment since those skilled in the art to which the invention pertains may make modifications or other embodiments of the principles of this invention, particularly upon considering the foregoing teachings. For example, one skilled in the art may secure the counterweight element to the housing 12 without the use of the apron 31. Therefore, by the appended claims, the applicant intends to cover any such modifications or other embodiments which incorporate those features which constitute the essential features of this invention.

What is claimed is:

1. A movable marking apparatus for marking a supporting surface comprising: a housing member; wheel means rotatably mounted to said housing member for engaging the supporting surface and rolling on the supporting surface; handle means secured to a rear portion of said housing for controlling said housing and pushing or pulling the housing along the supporting surface; and counterweight means disposed at a front portion of said housing to prevent inadvertent lifting of the front end of the housing away from the supporting surface.

2. The movable marking apparatus of claim 1, wherein said counterweight means includes an enclosure filled with a material which adds weight to the enclosure and said apparatus further comprises securing means for securing the counterweight means to the housing member.

3. The movable marking apparatus of claim 2 wherein said wheel means includes two pair of wheels mounted to said housing member with two axle members and said securing means includes an apron member which extends around said housing and defines openings through which said axle members extend.

4. An improved movable marking apparatus for marking a supporting surface, said apparatus having a housing member, wheel means rotatably mounted to said housing member for engaging the supporting surface and rolling on the supporting surface, and handle means secured to a rear portion of said housing for controlling said housing, said improvement comprising: a counterweight element disposed at a front portion of said housing to prevent inadvertent lifting of the front end of the housing away from the supporting surface.

5. The movable marking apparatus of claim 4, wherein said counterweight element includes an enclosure filled with a material which adds weight to the enclosure and said apparatus further comprises securing means for securing the counterweight means to the housing member.

6. The movable marking apparatus of claim 4 further comprising securing means for securing the counterweight means to the housing member wherein said wheel means includes two pair of wheels mounted to said housing member with two axle members and said securing means includes an apron member which extends around said housing and defines openings through which said axle members extend.

* * * * *